United States Patent [19]

Saunders et al.

[11] 4,093,227

[45] * June 6, 1978

[54] TARGET WITH IMPROVED SHOCK ABSORBER MEANS

[75] Inventors: Charles A. Saunders; Thomas Allen Saunders, both of Columbus, Nebr.

[73] Assignee: Saunders Archery Co., Columbus, Nebr.

[ * ] Notice: The portion of the term of this patent subsequent to Sep. 7, 1993, has been disclaimed.

[21] Appl. No.: 700,194

[22] Filed: Jun. 28, 1976

Related U.S. Application Data

[63] Continuation-in-part of Ser. No. 623,793, Oct. 20, 1975, Pat. No. 3,979,118.

[51] Int. Cl.[2] ..... F41J 7/04

[52] U.S. Cl. ..... 273/102.1 E; 273/102 S

[58] Field of Search ..... 273/102 S, 105.6, 105 R, 273/105 A, 102, 102.1, 1.5 R

[56] References Cited

U.S. PATENT DOCUMENTS

| | | | |
|---|---|---|---|
| 1,302,203 | 4/1919 | Nipper | 273/102.1 R |
| 1,544,453 | 6/1925 | Harbison | 273/1.5 R |
| 3,014,725 | 12/1961 | Lewis | 273/102 R |
| 3,181,849 | 5/1965 | Mitchell | 273/1.5 R |
| 3,398,955 | 8/1968 | Rakestraw | 273/105 R |
| 3,421,764 | 1/1969 | Smith et al, | 273/105 R |
| 3,602,505 | 8/1971 | Friend | 273/105 R |
| 3,674,270 | 7/1972 | Benjamin et al. | 273/105 R |
| 3,948,516 | 4/1976 | Jones | 273/1.5 R |

*Primary Examiner*—Richard C. Pinkham
*Assistant Examiner*—Lawrence E. Anderson
*Attorney, Agent, or Firm*—Kegan, Kegan & Berkman

[57] ABSTRACT

A marksmanship target supported by a moveable support arm, with a shock absorber interposed between the target and support arm. The shock absorber includes eight thin, resilient ribs extending from a circular hub mounted on the support arm to a marginal edge of the target, and integrally formed with the target.

7 Claims, 3 Drawing Figures

FIG-1
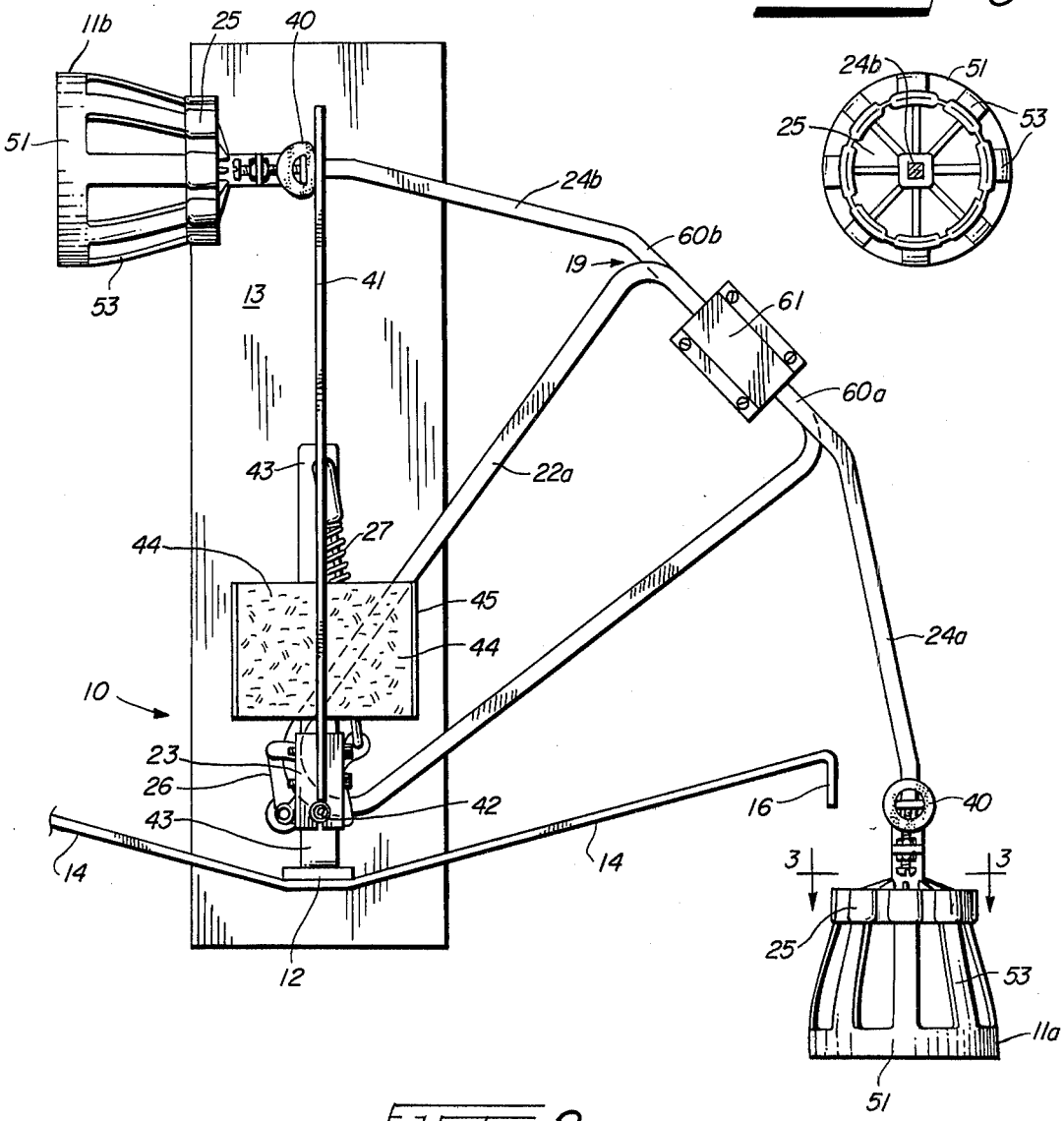
FIG-3
FIG-2
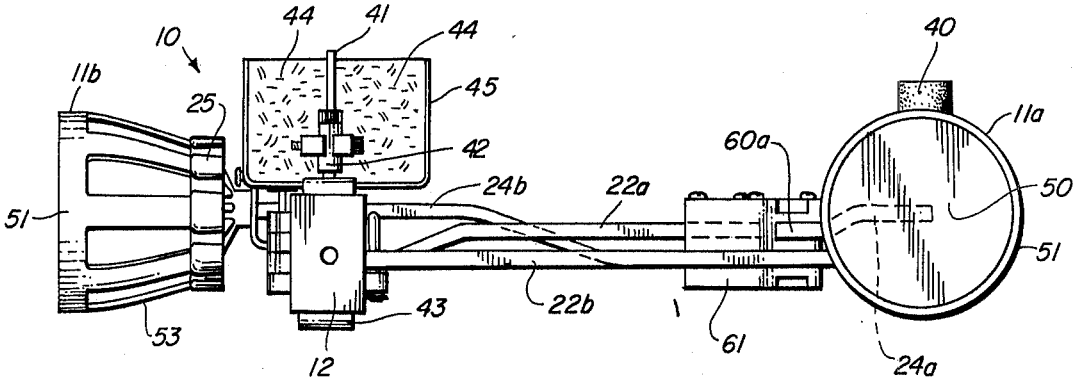

TARGET WITH IMPROVED SHOCK ABSORBER MEANS

This application is a continuation-in-part of co-pending U.S. patent application, Ser. No. 623,793 filed Oct. 20, 1975, now U.S. Pat. No. 3,979,118.

Applicants disclaim the term of patent extending beyond Sept. 7, 1993. This patent shall be enforceable only for and during such period as it is commonly owned with U.S. Pat. No. 3,979,118 issued Sept. 7, 1976.

BACKGROUND OF THE INVENTION

This invention relates to missile targets of the type used in contests among marksmen armed with slingshots, bows, air rifles and the like. Missiles are impelled at high velocities with the objective of producing a visible reaction in each target struck. When missiles are impelled at very high velocities it is essential to cushion the shock of missiles striking the targets in order to prevent damage to the target support assembly.

SUMMARY OF THE INVENTION

It is a principal object of the present invention to provide a target structure for cushioning impacts of missiles, thereby prolonging the useful life of an assembly supporting the target.

It is a related object of the invention to provide a shock absorber means for prolonging the useful life of fragile missiles such as arrows.

Yet another object of the invention is to provide a shock absorber means for a target which does not impair significantly the responsiveness of the target to missile impacts.

Other and further objects and advantages of the present invention will become apparent to persons skilled in the art from the following specification, taken in conjuction with the drawings.

BRIEF DESCRIPTION OF THE DRAWINGS

FIG. 1 is a fragmentary top plan view of a target assembly including a preferred embodiment of the shock absorber means of the invention;

FIG. 2 is a fragmentary front elevational view of the target assembly of FIG. 1, in which the shield 14 has been removed for purposes of clarity of illustration; and FIG. 3 is a rear elevational view taken along the line 3—3 of FIG. 1.

DESCRIPTION OF THE PREFERRED EMBODIMENT

Referring now to FIGS. 1 and 2, there is shown a target assembly 10 in which a pair of targets 11*a*, 11*b* are pivotally mounted on a support standard 12 firmly affixed to a stable, flat base 13. A protective shield 14 (shown only in FIG. 1) extends laterally outward from the standard 12, exposing to view only a single target 11*a*. Both lateral marginal edge portions 16 of the shield 14 project forwardly to minimize ricochet of missiles against the targets 11 or target arms 19 supporting the targets 11. When an exposed target is struck by a missile, the struck target shifts pivotally to an opposite lateral side of the shield 14.

The target assembly 10 of FIGS. 1 and 2 has only a single pair of targets 11 and is designed for practice use by a single marksman. For competitive use, a plurality (preferably at least four) pairs of targets 11 are independently suspended about a central vertical axle 20 in a vertical array. Each competing marksman then impels missiles toward targets 11 on a side of the shield 14 assigned to him, with the objective of shifting all exposed targets onto his opponent's side at the same time.

The targets 11 are mounted on an arm 19 pivotally supported about a vertical axle 20. An axle support 21 fixes the axle 20 to the support standard 12. The arm 19 is integrally formed from a ¼ inch × ¼ inch aluminum bar and includes a pair of pivot arms 22 bridged by an arcuate juncture 23, and a target support arm 24 forming an end extension of each pivot arm 22. Each target support arm 24 terminates in a circular hub 25.

A plastic collar 26 envelopes the arcuate juncture 23 and secures the arm 19 to the axle 20. A toggle or bias spring 27 maintains the targets in either a first rest position shown in FIGS. 1 and 2 with a first target 11*a* exposed to view, or a second rest position (not shown) in which the second target 11*b* is exposed on the other side of the shield 14. When a missile strikes an exposed first target 11*a* with sufficient force to overcome bias of the spring, that target 11*a* will shift in an arcuate path to its second rest position, out of view of the marksman.

Each target 11 is provided with an upwardly projecting, rearwardly facing foam rubber cushion 40 adapted to engage a laterally facing plate 41. This plate 41 is mounted pivotally on a vertical rod 42 supported by a support bar 43 extending behind the standard 12. The plate 41 is bounded on opposed lateral sides by a pair of sponges 44 encased in a generally U-shaped, upwardly opening metal envelope 45 mounted on the support bar 43. When a cushion 40 strikes the plate 41, the plate 41 swings laterally against one of the sponges 44 thereby further cushioning shock of the missile impact. This prevents rebound of the cushion 40 away from the plate 41.

Structure of the unique shock-absorbing targets of the invention is illustrated with reference to FIG. 3 in addition to FIGS. 1 and 2. Each target 11 includes a target face 50 surrounded by a thin lip 51 projecting forwardly of the face 50. Each target 11 also includes a circular hub 25 mounted on a target support arm 24. Eight longitudinally resilient ribs 53 are secured around a marginal edge of the target 11 and extend rearwardly to join the hub 25. These eight ribs 53 are molded integrally with the target face 50 and lip 51, and they cushion missile impacts without need for any accessory shock-absorbing structures such as springs or sponges.

As shown in FIG. 1, the target arm 19 is bent reversely to overlap in two short parallel sections 60*a*, 60*b*. A sleeve 61 affixed to one section 60*a* circumscribes a corresponding section 60*b* of the second target support arm 24*b*. This sleeve 61 ensures concordant movement of the respective support arms 24*a*, 24*b* and it also limits lateral, scissors-like movement of the arms 19 after a cushion 40 strikes the pivot plate 41.

Numerous equivalents of the preferred embodiment of the invention described above will occur to persons skilled in the art without departing from the spirit and scope of the following claims. This invention has been described with reference to a preferred embodiment, and no unnecessary limitations should be implied from the foregoing description.

What is claimed is:

1. In a marksmanship target assembly comprising an impact target producing a visible reaction to missile impacts, a target support arm supporting said target, and shock absorber means interposed between and connecting said target to said target support arm to cushion the impact of a missile striking said target;

the improvement wherein said shock absorber means comprises a plurality of annularly spaced, longitudinally resilient, linearly collapsible ribs secured to said target, said ribs terminating in hub means securing rearwardly directed posterior ends of said ribs to said target support arm, and wherein said target includes a target face circumscribed by a narrow forwardly extending lip; said face, said lip and said ribs being integrally formed from a thermoplastic substance.

2. The improvement as set forth in claim 1, wherein said target includes a generally planar target face extending normal to a line of flight of missiles impelled at said target, and wherein said ribs are displaced symmetrically about an axis normal to said target face.

3. The improvement as set forth in claim 1, wherein said target is generally circular and said hub means includes a generally circular disc having a diameter no greater than the diameter of said target.

4. The improvement as set forth in claim 3, wherein said ribs are secured circumferentially around a marginal edge of said target.

5. A marksmanship target assembly comprising an impact target producing a visible reaction to missile impacts and including a generally disk shaped target face, a target support arm supporting said target, hub means supported by said target support arm and including a generally circular disc having a diameter no greater than the diameter of the target face, and shock absorber means interposed between and connecting said target face to said hub means to cushion impacts of missiles striking said target, said shock absorber means comprising a plurality of annularly spaced, longitudinally resilient, linearly collapsible ribs formed integrally with said target face, said hub means securing rearwardly directed posterior ends of said ribs to said target support arm.

6. The target assembly of claim 5, wherein said generally disk shaped target face is a generally planar target face extending normal to a line of flight of missiles impelled at said target, and wherein said ribs are displaced symmetrically about an axis normal to said target face.

7. The target assembly of claim 6, wherein said ribs are secured circumferentially around a marginal edge of said target face.

* * * * *